US005115616A

United States Patent [19]

Nixon

[11] Patent Number: 5,115,616

[45] Date of Patent: May 26, 1992

[54] EDGEBANDED ACOUSTICAL PANELS

[76] Inventor: Michael T. Nixon, 2810 Urbandale La., Plymouth, Minn. 55447

[21] Appl. No.: 402,899

[22] Filed: Sep. 5, 1989

[51] Int. Cl.[5] ..... E04B 1/82

[52] U.S. Cl. ..... 52/144; 52/484; 52/821; 52/830

[58] Field of Search ..... 52/821, 829, 830, 144, 52/145, 747, 484; 181/290, 291, 284; 428/194, 192

[56] References Cited

U.S. PATENT DOCUMENTS

| | | | |
|---|---|---|---|
| 3,092,203 | 6/1963 | Slayter et al. | 52/144 X |
| 4,026,081 | 5/1977 | Delaney et al. | 52/145 X |
| 4,146,999 | 4/1979 | Petrovec | 52/145 |

OTHER PUBLICATIONS

*Adhesives In Building Construction*, US Dept of Agriculture Handbook No. 516, Feb. 14, 1978, p. 80.

*Primary Examiner*—David A. Scherbel
*Assistant Examiner*—Linda Watson
*Attorney, Agent, or Firm*—Haugen and Nikolai

[57] ABSTRACT

Acoustical panels made of a low density fiberglass core are disclosed. A banding is applied to the edges of the core using a suitable adhesive. The panel can then be covered with paint, a woven fabric or a material impermeable to water and/or the transmission of loose fibers. Also disclosed are techniques for easily modifying such panels in the field for installation.

9 Claims, 4 Drawing Sheets

EDGEBANDED ACOUSTICAL PANELS

The present invention relates to fiberglass panels of the type use in construction for acoustical purposes. More specifically, the present invention relates to low density fiberglass panels to which an edgebanding has been applied so that the panel will maintain the desired shape and its structural integrity during normal use. The use of edgebanding, rather than prior art techniques, also makes it possible to quickly and easily modify the panel for installation in the field.

BACKGROUND OF THE INVENTION

Fiberglass, as a component for products, can be classified by density. Low density fiberglass is generally between two and four pounds per cubic foot. Medium density fiberglass is generally between four and seven pounds per cubic foot. Fiberglass is considered high density if it is above seven pounds per cubic foot. While there is little difference from an acoustical standpoint between one inch thick fiberglass having a density of three pounds per cubic foot or seven pounds per cubic foot, the higher density fiberglass costs more than twice that of the low density material.

Even though the higher density material costs more, the industry has gravitated in that direction. The industry has seen that it is necessary to harden or stiffen the edges of the panel. This has typically been done chemically by applying a liquid resin containing a hardening agent to the edge. When, for example, a polythermal setting resin is applied to the fiberglass core, it wicks into the core to a depth consistent with the amount applied. The resin then hardens binding the edge fibers of the core into a solid mass. The depth of the hardened mass is normally $\frac{1}{8}$–$\frac{1}{4}$.

This technique works better with higher density fiberglass because the air spaces between the fibers are smaller and more fibers are present to hold the liquid resin as it hardens. When this technique is used with low density fiberglass, the edges do not become stiff. Instead, they remain spongy and pliable. Even when used with high density fiberglass, this process is inefficient.

First, the chemical reaction which causes resin to set up normally will take anywhere from one to six hours depending on the temperature, humidity or the amount of catalyst that is mixed with the resin. Second, the panel edges need to be separated while the resin agent hardens otherwise the panel edges will bond together. Third, during application and curing, the resin chemicals typically used emit odors that are difficult to control. As a consequence some manufacturers are switching to water based polymer hardening compounds. While such hardening agents are less costly and do not emit odors, they take at least 24 hours to dry into a hardened state and also require the panels to be separated during the drying period. Fourth, when used on long, narrow panels, the hardening of the resin often causes the panel to bow or warp along its length.

Finally, panels constructed using impregnated techniques cannot be easily and acceptably modified in the field. Panels typically need to be trimmed to fit within a room. Panels also need to be trimmed or cut to permit installation around electrical fixtures and outlets, HVAC vents, plumbing fixtures and sprinkler heads. Also, treating cut edges in the field with a resin stiffener is totally impractical.

SUMMARY OF THE INVENTION

The present invention solves these problems by eliminating the need to treat the edges with a resin based stiffener. As a result odors and time delays associated with curing and hardening are eliminated. Most importantly, the present invention permits low cost, low density fiberglass to be successfully used in place of the more expensive higher density material used in prior art products. It also permits fiberglass panels to be cut and trimmed in the field to accommodate varying room dimensions, fixtures and vents.

Described in extraordinarily simple terms, this invention contemplates edgebanding a fiberglass core with any of a variety of materials using a suitable adhesive. Edgebanding in its most common use is the process by which exposed edges of millwork and furniture components are concealed with decorative facings to provide a finished appearance. While the principle of edgebanding remains essentially the same, the processes by which it can be accomplished with respect to low density fiberglass varies significantly.

For the purposes of this invention, it is proposed that hot melt or heat activated adhesives be used. While liquid contact adhesives require time to vent the excess liquids leaving the residue in a contactable state, hot melt and heat activated adhesives set up almost instantaneously. As a consequence, hot melt and heat activated adhesives yield a continuous high speed production process. Through considerable experimentation with many types of core materials, it has been determined that the perimeter edges of such materials possess sufficient strength against compression to permit the application of relatively lightweight and inexpensive edgebanding materials.

That fiberglass semi-rigid insulations can be successfully edgebanded is surprising for a number of reasons.

First, the nature of the soft, loose fibrous mat has erroneously led those working in the art to believe that the fibers are prone to shedding or breaking out under impact. Those skilled in the art have generally believed that ordinary adhesives would not adhere to fiberglass because the fibers lack sufficient anchorage for the adhesives to maintain a permanent bond.

Second, fiberglass panels are generally comprised of multilayers of fiberglass strands which, when joined together, produce a lightly bonded layered composition which is easily compressed. The layers may be easily split apart and give the appearance and impression of being a relatively soft non-structural type of panel material.

Third, as a soft material, the material is prone to flexing along its long and short axis when produced in panel sizes of 4'-0" wide by 8'-0" long as an example.

Fourth, heat activated adhesives, until now, were generally thought to be unacceptable for use with fiberglass because of its insulative qualities. As a result, the view generally held in the industry has been such adhesives take too long to set up. Through experimentation it has been determined that such problems are not severe and be easily overcome using simple mechanical means to cool the banding once the adhesive has been applied.

As a result of these misconceptions of fiberglass has historically been used only in acoustical applications as follows:

1. Lightweight fiberglass has been used in relatively small sizes where the span characteristics are consistent with the size, density of the fiberglass, composition and lay of the glass fibers, and the weight and method of the finished surface material. Also, the thickness of the material is a factor as is the supporting methods and designs of affixing the finished product in place.

2. In larger size panels, thickness and density have been increased to improve the span characteristics or the rigidity of the panel along its longest axis.

3. In some cases the flexural strength of the fiberglass along its long axis has been increased by bonding a lightweight facing to both faces of the board material. Such improvement, however, is limited.

4. In general, where fiberglass has been used as an acoustical core material for custom designed decorative wall and ceiling panels, the means of rigidifying the core materials and/or the finished product are generally as follows:

a. A panel including an independent frame capable of accepting the fiberglass as an infill within the confines of said frame. Such frames can be of steel, aluminum, wood or plastic.

b. A panel having perimeter edges hardened with a liquid agent which, when applied to the panel edge, wicks into the fiberglass, fills the voids between the fibers, and binds them into a hardened mass. Such methodology produces an integral frame which rigidifies the panel perimeter, thus providing protection to the otherwise soft fiberglass edge and also provides greater structural attributes to the panel as a whole. As set forth above, this process only works well with higher density core materials.

c. A panel having an increased density and thickness to provide sufficient strength to the panel to permit heavy fabrics to be applied directly without the need for additional edge-hardening agents. Such a method has severe limitations with respect to the type of decorative or finished facings that can be utilized.

d. A panel having semi-rigid fiberglass fitted within an edge molding in the form of a "U" channel. A decorative facing is stretched over the panel face without, or barely, touching the core material and is attached to the "U" channel molding at the panel edges and around to the back of the panel. Such a method is also limited to those fabrics that are stretchable and are not influenced by heat and humidity which could cause the fabric to sag and bag.

In summary, the techniques available in the prior art have required manufacturers to carefully consider the design, shape and size of the finished panel. The use to which the panel will be put, the environment in which it will be located, and the manner in which it will be installed also play a role in the selection of component parts. In addition to the physical characteristics of the panel and its acoustical core selection, further limitations are imposed by the type of fabric facing that can be selected and the manner in which it can be applied to the panel.

The present invention is intended to simplify the process of selection and, in many instances, will provide the potential of using lighter Weight, more economical forms of fiberglass. Moreover, the invention will increase the use of fiberglass by reason of the processes and techniques disclosed which will permit fiberglass to be used in ways not currently available on the market.

DESCRIPTION OF THE DRAWINGS

FIG. 5 is a cross section view showing how edgebanding can be used to make field modifications to the panel.

DETAILED DESCRIPTION OF THE INVENTION

Figure 1:
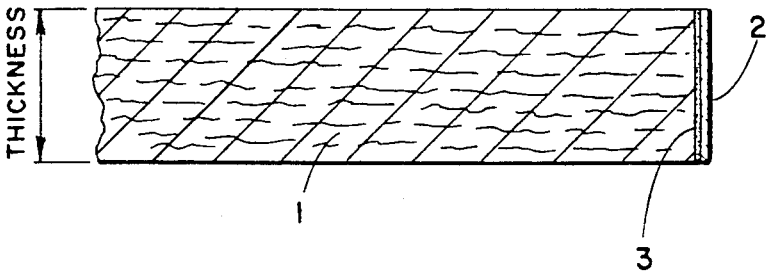
FIG. 1 is a cross sectional view showing a thin edgebanding material adhered to a low density fiberglass panel.

In most general terms, the present invention includes a core 1 and a band 2 secured to the edge(s) of core 1 with a suitable adhesive 3. The core 1 is preferably made of fiberglass or some other suitable fibrous material (synthetic or natural) which exhibits good acoustical characteristics. While the desired results can be achieved when the core 1 is of any suitable density for acoustical performance, the many advantages of the invention are most apparent when the core 1 has a uniform density of two to four pounds per cubic foot.

The band 2 can be constructed of a wide variety of materials including cardboard, paper, metal, wood, or extruded plastics. The adhesive 3 can be a water based polymer or solvent based adhesive applied in a very fine mist. Preferably, however, the adhesive 3 will be a hot melt/heat activated adhesive having a high solid content.

When an adhesive 3 of the hot melt type is applied to an edge of core 1 in a continuous strip, a limited penetration of the outermost fibers of the core by the adhesive 3 is achieved. The adhesive 3 contacts the fibers of the core's edge and locks the fibers into position against the band 2. The band 2 and core 1, as a result, are stiffened, fixed and locked into a permanent position with respect to each other. The result is a panel which is sufficiently reinforced to make it acceptable for many purposes.

When the core 1 and band 2 are so joined to form a panel, the panel displays a hard edge as well a the frame-like quality that will allow the panel to more readily resist the flexural action along the axis of its long dimension. Experimentation has revealed that the degree of hardness and stiffness of the panel edge can be varied by using different materials such as steel, aluminum, high pressure laminates, plastics and paper-type materials for the band 2. Varying the type and degree of adhesive 3 used can also produce desireable and predictable qualities.

As stated above, then the band 2 is secured to the edges of core 1 with a suitable adhesive 3, the fibers on the extreme edge of the core 1 coated with the adhesive are locked into a fixed position. The fibers adjacent to the adhesive coated fibers pick up compressive strength without breaking the fiber/binder bond. In the center of core 1 further away from the edge may readily show its compressibility and resiliency without damage to the finished panel.

There are a number of ways and materials that can be employed in principle to achieve the process of securing a band 2 to the edge of a light to heavy density fibrous glass or wool core 1. In the context of a particular product design one may be more applicable than the another. In general, however, they all use the same principle to achieve the same end results.

First, the adhesive 3 may be applied to the edge of core 1 by means of an applicator which offers a layer to molten adhesive directly to the core's edge. Almost simultaneously the band 2 is applied continuously over the adhesive 3. The band 2, under pressure, is thus contacted to the core's edge. The pressure will drive in the excess adhesive to make a continuous and positive contact with the fibers of core 1 thus locking them into a fixed position.

Second, the band 2 may contain a preapplied film of adhesive which is activated by heat as it is continuously applied to the edge of core 1. By this method and with this type of material, the band 2 may be secured to the core using automated and semi-automated equipment or may be simply ironed on with an iron or similar heating device.

Third, an independent film or web of adhesive 3 may be applied to the edge of core 1 in a dry state. The band 2 can then be overlaid on the adhesive 3 which is heat activated to produce a bond.

Fourth, the edge of core 1 can be treated with a liquid adhesive 3 which is then allowed to dry. In its dry state the adhesive 3 becomes thermoplastic which may be reactivated by applying heat. Band 2, when applied to the edge will adhere to the softened thermoplastic adhesive 3. When the adhesive 3 cools, the bond between the edge of core 1 and the band 2 becomes permanent.

Fifth, a hot melt adhesive 3 can be heated to a liquid state and applied to the band 2 which in turn is contacted to the edge of core 1 in a continuous process under pressure. When the adhesive 3 cools it provides a permanent bond between the core's edge and band 2.

Each of the above described methods has proven successful. The preferred methods, however, are those which contemplate the use of a heat activated hot melt adhesive applied to the backed band 2 or the use of a liquid hot melt adhesive applied to the banding material immediately prior to the application to the edge of core 1.

Use of the techniques and materials described above produce both lower material and labor costs. The invention reduces the number of operations required to harden panel edges and significantly reduces the time delays due to curing of resins used in prior art edge hardening processes. Securing a band 2 to the edge of core 1 using a suitable adhesive 3, by comparison is fast, continuous, instantaneous and more economical.

Figure 2:
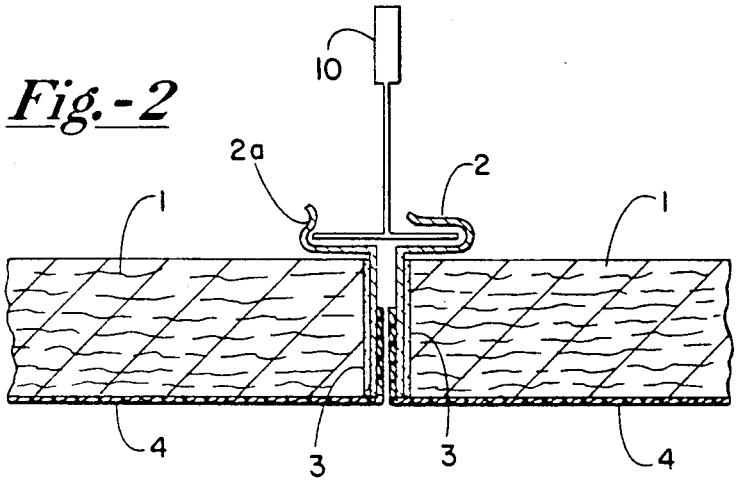
FIG. 2 is a cross sectional view showing how specially designed edgebanding can be used to secure the panels to a hidden tee bar suspension system.
Figure 3:
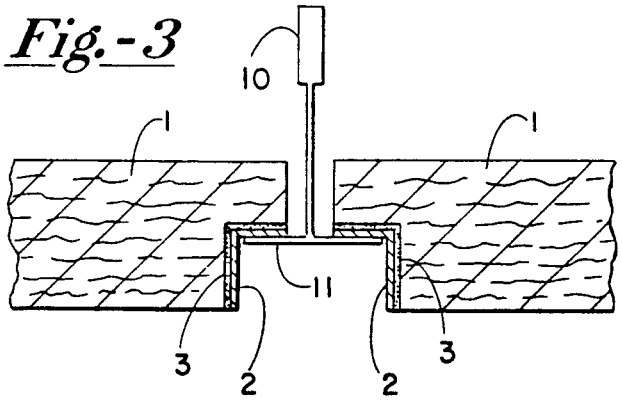
Figure 4:
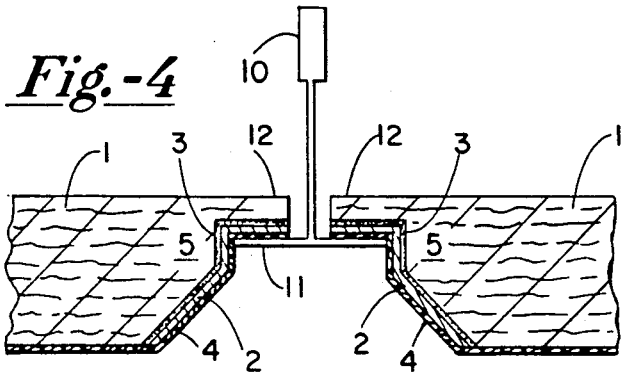
FIG. 4 is a cross sectional view showing how edgebanding can be used to provide a chambered lay-in reveal time.

FIGS. 2, 3 and 4 are present to show how the basic invention presented above can be utilized in conjunction with a typical suspended grid 10 to support acoustical ceiling tiles. FIG. 2 specifically shows how such panels can be made and used in conjunction with such a grid 10 to conceal the grid 10. As shown, the panel includes a low density fiberglass core 1, a specially formed band 2 which is adhesively secured to the fiberglass core, and a fabric wrap 4. As shown, the band 2, which can be made of either plastic or a pliable metal includes a locking section **2*a* which is sufficiently flexible to snap into place around the cross member 11 of the grid 10 to lock and retain the panels in place. In FIG. 3, the fiberglass cores 1 are cut to form a contour 5 to which band 2 is secured. In this embodiment, a portion of the resulting panel rests on top of cross member 11 of the grid 10 so that the grid 10 is revealed. FIG. 4 shows another reveal type system. This time the core 1 is cut to have a chamfered profile and the band 2 which is adhered to the core 1 includes a lip 12 which rests upon the cross section 11 of the grid 10** to support the panel.

Figure 5:
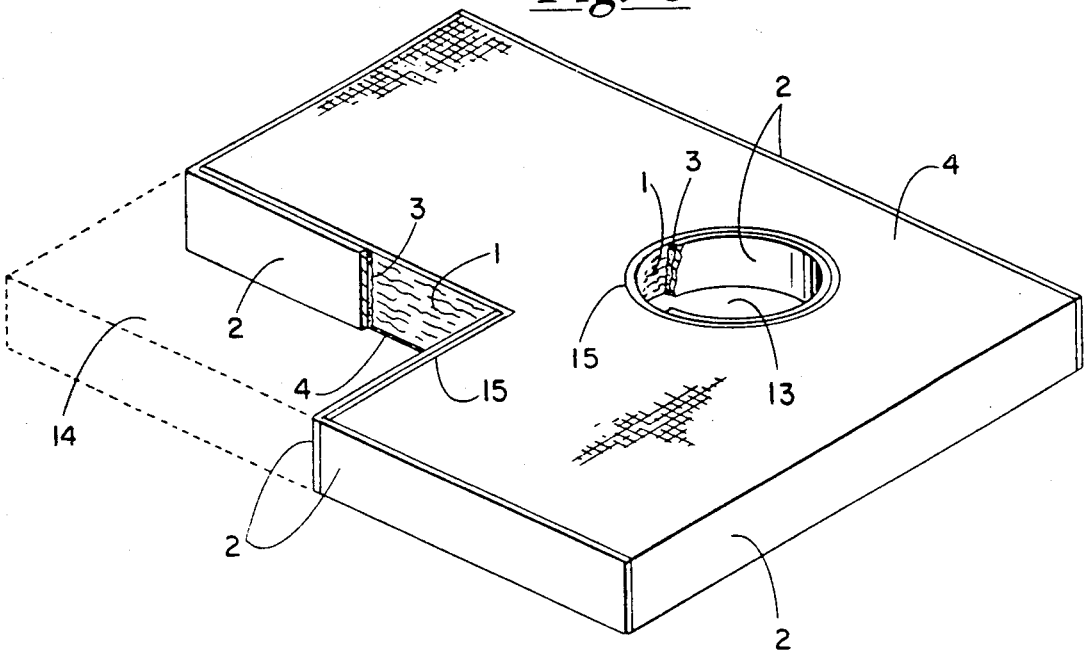
FIG. 5 is a cross sectional view showing how edgebanding can be used to provide a standard lay-in reveal tile so the edgebanding covers the exposed edge of the core material and reinforces the tile against sagging.

FIG. 5 shows that panels made in accordance with the present invention can be readily modified in the field so that they can be fitted around plumbing, heating and lighting fixtures. When manufactured in the plant, the panel of FIG. 5 would have a square or rectangular shape. The panel of FIG. 5 can be then be cut in the field to form notch 13. A band 2 can then be applied to the edges of notch 13 using a heating iron to activate adhesive 3. Similarly, a hole 14 to receive a sprinkler head, light fixture, or the like could be cut through the panel and the edge formed when the cut is made can then be dressed out with a cylindrical band 14 to encapsulate the core 1. Again, a heating iron could be used to activate the adhesive 3 which secures the band 2 to the core 1 along the edge formed by the cut. To ensure a perfect seal a bead 15 of silicone sealer or caulk could be used between any covering over the core 1.

Figure 6A:
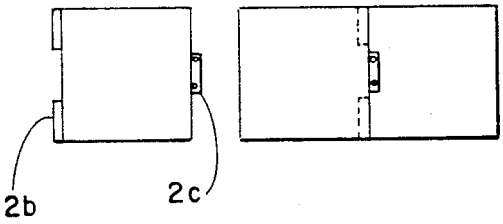
FIG. 6 is a plan view of three panels including interlocking edgebanding.
Figure 6B:
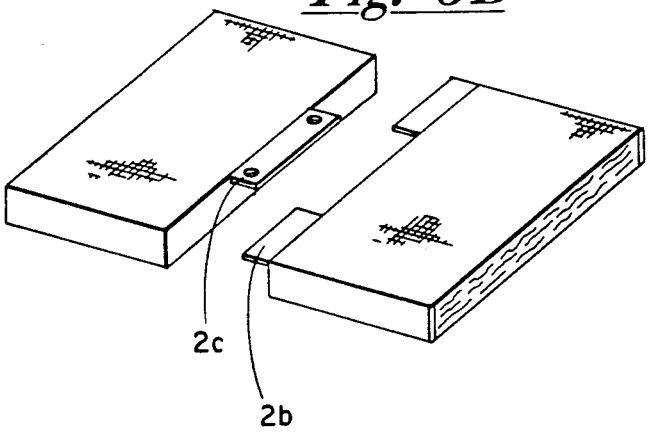
Figure 6C:
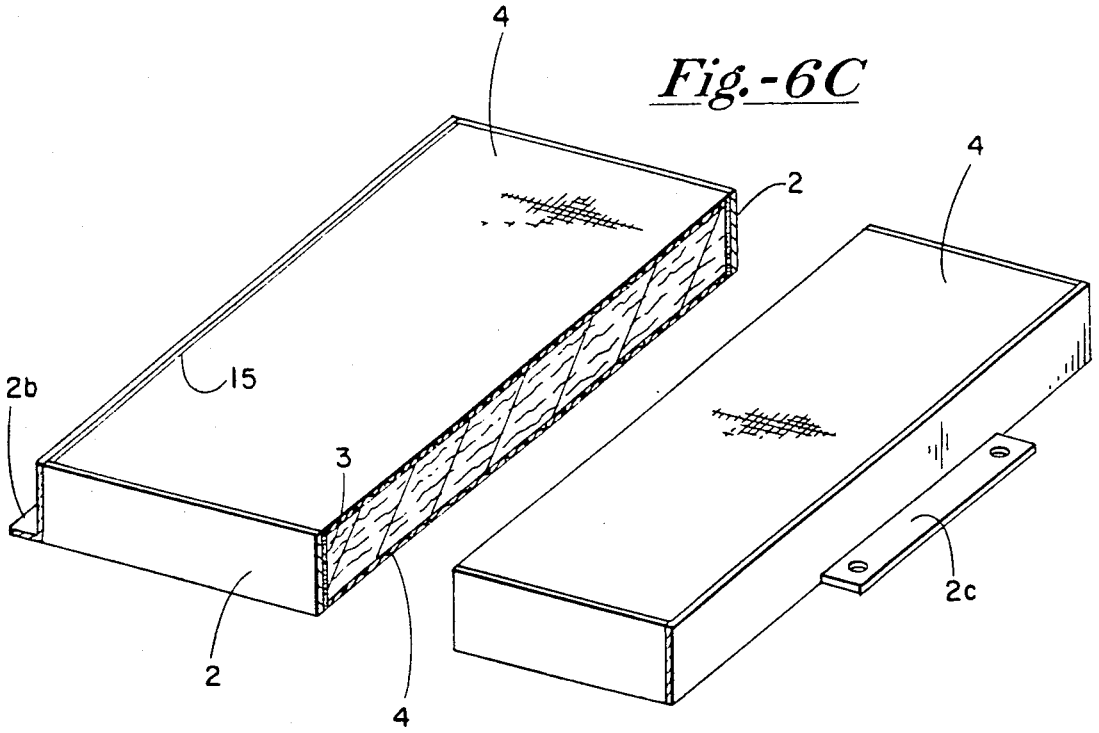

FIG. 6 is of interest because of its teaching of an interlocking grid system for securing the panel to a wall or ceiling. Each panel is designed to include along one of its edges a band 2 including a pair of right angle interlocking members **2*b* separated by a fixed distance. The opposite edge of the core is adhered to a band 2 having a right angle interlocking tab 2*c* projecting therefrom which is centrally located and has a length corresponding to the distance between the tabs 2*b*. Given this construction, tab 2*c* of one panel will fit between tabs 2*b*** of the adjourning panel for installation. Installation can be achieved by using mechanical means such as a screw or rivet arrangement or by gluing up the tabs to an existing wall or ceiling.

Figure 7:
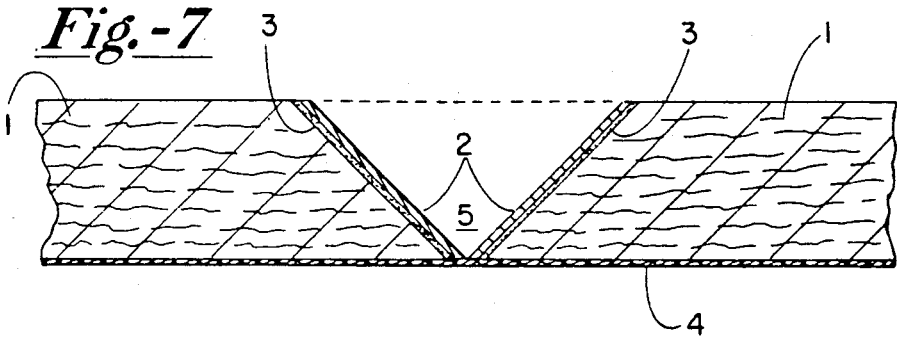
FIGS. 7 and 8 are cross section views showing how a panel having a reinforced miter fold can be made using edgebanding.
Figure 8:
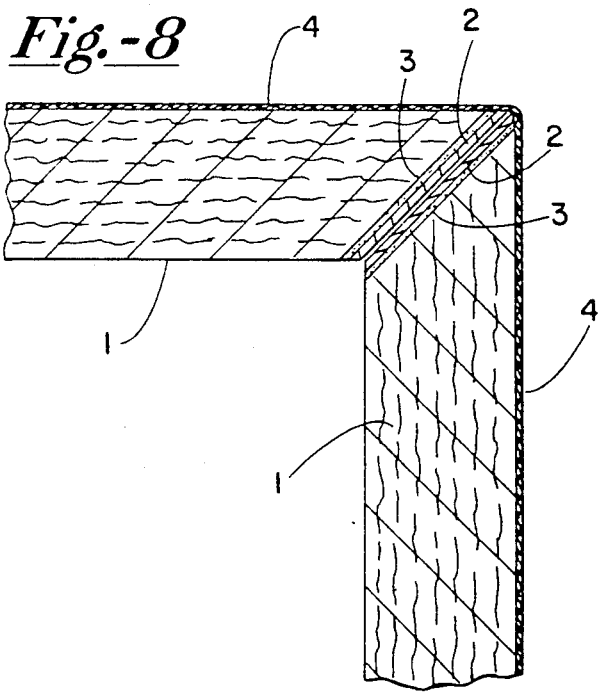

FIG. 7 is of interest for its teaching of how the system of the present invention can be used to form a reinforced miter fold for trimming corners. Specifically, the panel having the miter fold is constructed of a low density fiberglass core 1 having a fabric cover 4 adhered to one of its surfaces. The opposite surface includes an elongated notch 5 along its entire length which is in the form of a right angle. A band 2 is then applied to each surface of the notch 5 in the same manner set forth above. The panel can then be folded over so that the bands 2 on each surface of notch 5 are in face to face registration and the panel forms a right angle, the apex of which is completely covered by the fabric cover 4 as shown in FIG. 8.

Figure 9:
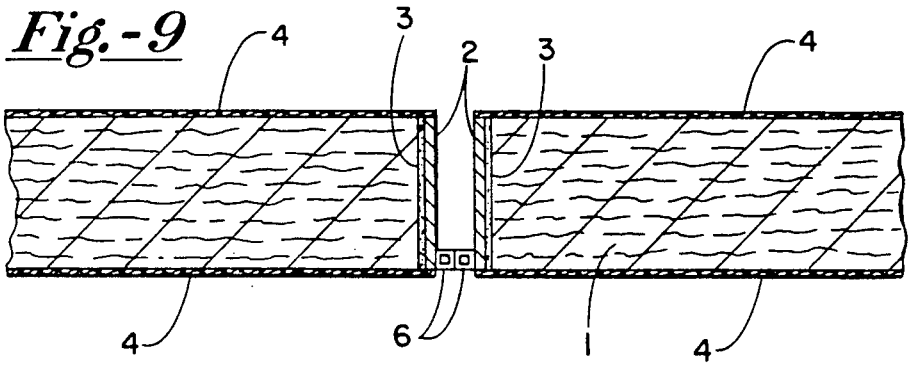
FIG. 9 shows an edgebanded acoustical tile system particularly suited for a clean room environment.

The panel system shown in FIG. 9 is particularly wellsuited for use in a clean room manufacturing environment. As shown, each panel includes a fiberglass core 1 to which a dual derometer PVC extrusion band 2 has been adhered using a hot melt or heat activated adhesive 3. Associated with each of the banding members 2 is a soft vinyl bulb 6 which is intended to abut the adjacent panel to ensure a good seal between the panels. The panels are also faced with an impermeable film 4 so that moisture cannot get into the fiberglass core 1 and so that fibers from the core will not become ambient. Again, field cuts can be made with such panels as described above and the silicone sealer can be used to cover any voids where the film facing 4 or banding 2 does not completely cover the fiberglass core 1.

It should be understood that the foregoing description is merely illustrative and that certain changes and modifications may be practiced without deviating from the spirit of the invention as limited by the scope of the appended claims.

I claim:

1. An acoustical panel comprising:

a. a core made of a fibrous material, said core having a generally uniform density throughout and including a pair of side surfaces and at least one edge surface which has not been treated with a resin based stiffener;

b. a banding member having a first surface and a second surface;

c. a heat activated adhesive for joining said first surface of said banding member in surface to surface registration with said edge surface of said core so that said banding member and said core mutually support each other to reduce the flexibility of the core along at least one axis.

2. The acoustical panel of claim 1 wherein said core is made of fiberglass.

3. The acoustical panel of claim 2 wherein the fiberglass of said core has a density between 2 and 4 pounds per cubic foot.

4. The acoustical panel of claim 1 wherein said banding member includes means for mounting said panel in a desired location.

5. The acoustical panel of claim 4 wherein said banding member is made of an extruded plastic.

6. The acoustical panel of claim 1 including a facing secured to at least one side of said core.

7. The apparatus of claim 6 wherein said facing is a woven fabric.

8. The apparatus of claim 6 wherein said facing is made of a material which is impermeable to moisture and prevents fibers from the core from escaping through the facing.

9. A method for fitting in the field panels including a core made of a fibrous material, said core having a generally uniform density throughout and including a pair of side surfaces and at least one edge surface; a banding member having a first surface and a second surface; a heat activated adhesive for joining said first surface of said banding member in surface-to-surface registration with said edge surface of said core so that said banding member and said core mutually support each other to reduce the flexibility of the core along at least one axis; and a facing secured to at least one side surface of said core, said method comprising:

a. cutting the panel to form one or more new edges as required to fit;

b. applying a banding member to each new edge using an heat activated adhesive; and c. applying a silicone sealer along the sides of each banding member as needed to seal any openings between said facing and banding member through which fibers from the core or moisture might otherwise pass.

* * * * *